US005452585A

United States Patent [19]

Pincus et al.

[11] Patent Number: 5,452,585

[45] Date of Patent: Sep. 26, 1995

[54] CIRCULATION OF OIL IN REFRIGERATION SYSTEMS WITH IMMISCIBLE REFRIGERANT-OIL COMBINATIONS

[75] Inventors: Steven J. Pincus; Calvin D. MacCracken, both of Englewood, N.J.

[73] Assignee: Calmac Manufacturing Corporation, Englewood, N.J.

[21] Appl. No.: 262,680

[22] Filed: Jun. 20, 1994

Related U.S. Application Data

[63] Continuation-in-part of Ser. No. 36,901, Mar. 25, 1993, Pat. No. 5,353,602.

[51] Int. Cl.[6] ..... F25B 43/02

[52] U.S. Cl. ..... 62/84; 62/471

[58] Field of Search ..... 62/84, 224, 527, 62/471

[56] References Cited

U.S. PATENT DOCUMENTS 1,314,234 8/1919 Wolf ..... 62/224 X 1,768,603 7/1930 Hull ..... 62/224 X 4,715,196 12/1987 Sugiura ..... 62/84 X 5,355,695 10/1994 Kawaguchi et al. ..... 62/84 X

*Primary Examiner*—William E. Wayner

*Attorney, Agent, or Firm*—Charles J. Brown

[57] ABSTRACT

In a refrigeration or air-conditioning process, a method applicable to the replacement of potentially ozone-depleting oil-miscible refrigerants such as R-12 with non-ozone-depleting oil-immiscible refrigerants such as R-134a, wherein a conventional expansion device is replaced by a self-regulating pulsed nozzling device for pulsed circulation of the immiscible oil in the new refrigerant to create accelerated intermittent high velocity bursts of substantially unrestricted refrigerant flow imparting sufficient momentum to move the oil with the refrigerant through all stages of the process.

7 Claims, 1 Drawing Sheet

CIRCULATION OF OIL IN REFRIGERATION SYSTEMS WITH IMMISCIBLE REFRIGERANT-OIL COMBINATIONS

CROSS REFERENCE TO RELATED APPLICATION

This application is a continuation-in-part of my application entitled "Non-Steady-State Self-Regulating Intermittent Flow Thermodynamic System" filed Mar. 25, 1993 and given Ser. No. 08/036,901, now U.S. Pat. No. 5,353,602.

BACKGROUND OF THE INVENTION

In the current changeover of refrigerants from chlorine-containing potentially ozone-depleting refrigerants to substantially non-chlorine-containing substantially non-ozone-depleting refrigerants, the refrigeration industry has been unable to replace refrigerant without necessitating major system changes. The simplest system change is substitution of a new expansion device. The most complex system change is a replacement of the system lubricating oil. Due to their lack of chlorine content, non-ozone-depleting replacement refrigerants are immiscible (i.e. insoluble) with lubricating oils presently circulated for compressor lubrication. Mineral oil is conventional for this purpose. It is miscible in refrigerants previously used but not in the new non-ozone-depleting refrigerants. Thus this advent of the replacement refrigerants has led to compressor failures due to inadequate return of immiscible oil.

There are two principal mechanisms for oil return in a refrigeration system: Refrigerant velocity and refrigerant solubility. By changing to oil-immiscible refrigerants, the solubility mechanism of oil return is removed. The refrigerant velocity mechanism is substantially unchanged when one utilizes conventional throttling expansion devices. The velocity mechanism of known oil return systems is simply insufficient to return oil with the replacement refrigerants, resulting in compressor failures.

The present conventional approach to the problem of oil return is to replace the oil when changing refrigerants, converting to oils which are miscible with the replacement refrigerants. Changing refrigerant system oil is an involved procedure calling for as many as four consecutive processes of flushing the system with the replacement oil, followed by a test of oil composition to insure relatively complete oil changeover. The process is protracted, in part due to the fact that the refrigerant oil is spread throughout the entire system and, since the old oil is non-soluble in the replacement refrigerant, there is no direct mechanism of washing out oil films from the system tubing walls.

Further problems with replacement oils, other than complete changeover, occur due to other chemical properties of the oils. The replacement oils are highly hydro-phillic, which simply means that they absorb water very easily and very quickly. Water vapor is a bane to refrigeration systems, and must be removed by pulling deep system vacuums prior to charging with refrigerant. The replacement oils, by absorbing water when exposed to ambient conditions, lead to unnecessary problems of water vapor presence within the refrigerant system. Water contamination of the replacement oils is difficult to detect visually, resulting in the recommended procedure of not using any replacement oil that has been exposed to ambient air. This leads to the discarding of any unused replacement oil which in general is extremely expensive.

A typical system changeover involves substituting R-12 with R-134a and replacing the lubricating mineral oil with polyol ester oil. The present invention enables a system changeover from R-12 to R-134a without requiring a change in lubricating mineral oil. R-12 and R-134a are recognized designations for refrigerants as deemed acceptable by EPA and provided in ASHRAE Standard 34.

Mineral oil miscible in the refrigerant in accordance with conventional practice deposits itself in a continuous thin film on interior parts of the system to achieve a good lubricating effect on the moving parts of the compressor. Conversion over to non-ozone-depleting refrigerants in which mineral oil is immiscible, while still using standard throttling devices to effect expansion, not only fails to move the oil satisfactorily throughout the system but also fails to achieve an effective continuous lubricating film on the compressor parts. Also, in failing to move the oil satisfactorily, pooling results in low parts of heat exchanger components of the system which effectively nullifies any heat exchange function where pooling occurs. It has been found, however, that by the practice of the method of this invention the high velocity bursts of refrigerant not only carry the immiscible oil throughout all stages of the process but deposit it in a film on the moving parts of the compressor comparable in good lubricating effect to the thin film achieved by mineral oil miscible in the refrigerant.

SUMMARY OF THE INVENTION

The invention concerns a refrigeration process wherein a refrigerant circulates through successive stages of evaporation, compression, condensation and expansion. The invention provides a method for simultaneously circulating with the refrigerant a lubricating oil immiscible in the refrigerant. In this method the expansion is effected by directing the refrigeration through a valve and nozzle in a nozzling device downstream of the condensation stage and upstream of the evaporation stage of the process. The valve is automatically fully opened and closed in a binary fashion in response to sensing at least pressure of the refrigerant to create accelerated intermittent high velocity bursts of substantially unrestricted refrigerant flow from the nozzling device carrying through all stages of the process. These bursts of refrigerant flow impart to the immiscible oil sufficient momentum to move the oil with the refrigerant through all stages of the process.

This refrigeration process comprises a suction side from the expansion through evaporation to compression and a discharge side from compression through condensation back to expansion. In a preferred form of the method of the invention the bursts of refrigerant flow are primarily positive impulsion pulses through the suction side of the process and primarily negative expulsion pulses through the discharge side of the process. The impulsion pulses increase fluid flow pressure and the expulsion pulses decrease fluid flow pressure. Together the pulses accelerate mass flow of the refrigerant sufficiently to move the immiscible oil through all stages of the process.

The opening and closing of the valve is preferably in response to sensing changes in the degree of superheat in the refrigerant flow leaving the suction side of the process. In particular the changes in the degree of superheat may be sensed by monitoring changes in temperature between evaporation and compression and in relation to changes in pressure between expansion and evaporation.

DESCRIPTION OF PREFERRED EMBODIMENT

Figure 1:
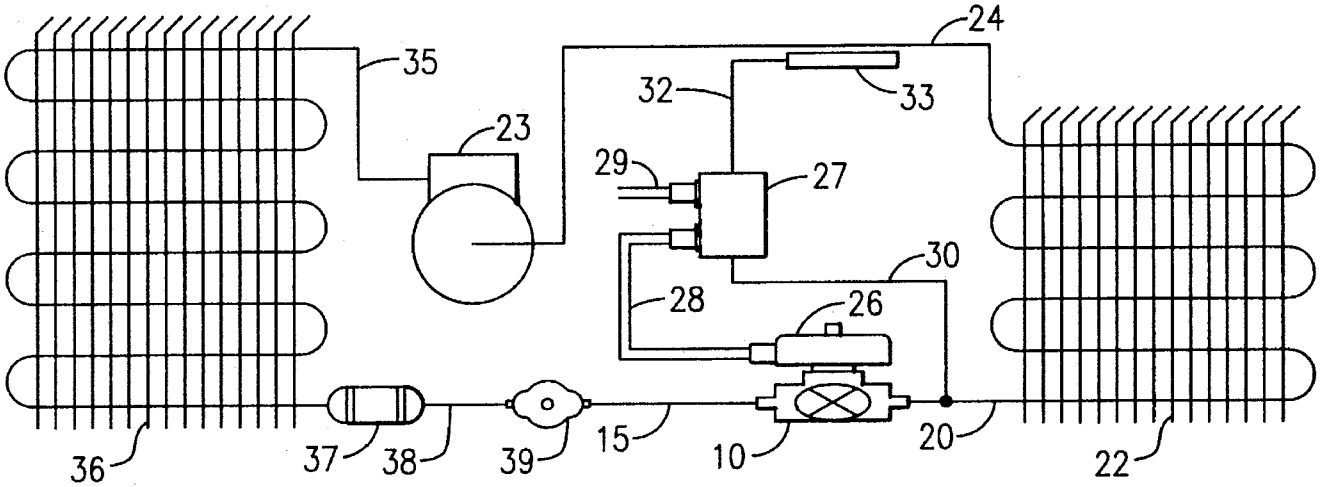
FIG. 1 is a schematic of a refrigeration or air-conditioning system utilizing a pulsed nozzling device for pulsed circulation of immiscible oil in a refrigerant.
Figure 2:
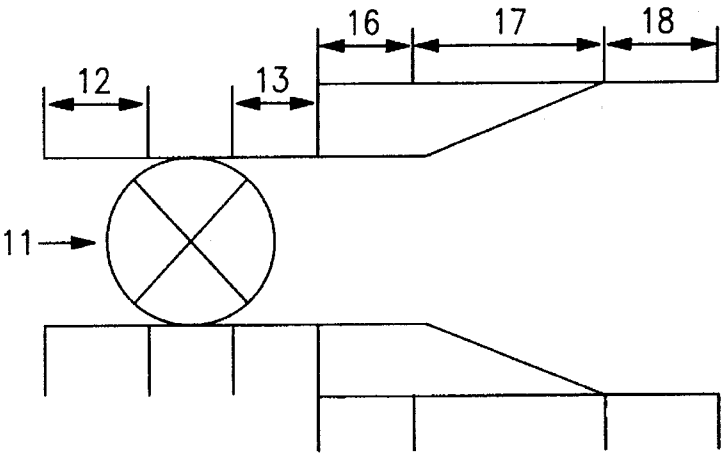
FIG. 2 is a schematic of one form of a nozzling device in which a valve element operates in conjunction with a nozzle element to achieve the pulsed fluid flow.

In the refrigeration system (which term as used herein includes an air-conditioning system) shown in FIG. 1, a nozzling device 10 provides for high velocity pulse mass flow. As shown in FIG. 2, the nozzling device 10 includes a valve element inlet 11 with a valve inlet 12 and a valve outlet 13. The valve element 11 may be a separate commercially available unit actuated in a binary fashion, either fully open or fully closed, with full port flow in its open condition and no flow in its closed condition. The inlet 12 of the valve element 11 functions as the inlet to the nozzling device 10 and as a transition element for connection to an inlet conduit 15 shown in FIG. 1. The outlet 13 functions as a transition element for connection with a straight nozzle section 16 and as such functions as the nozzle inlet as well. The straight nozzle section 16 leads to a diverging nozzle section 17 to produce a complete straight-diverging nozzle, which may also be a commercially available unit. A nozzle outlet 18 functions as the outlet of the nozzling device 10 and as a transition element for connection to an outlet conduit 20 shown in FIG. 1. Thus the nozzle 16-18 and the valve 11 are associated in series with respect to fluid flow, with the valve 11 preceding the nozzle 16-18. Depending on design considerations, the size and shape of the nozzle sections 16-18 can vary.

Alternatively, the nozzling device 10 may provide a valve element 11 downstream of the nozzle 16-18 or the valve element 11 may be located within the nozzle 16-18. The copending application referred to hereinbefore describes those alternate forms in more detail. In any case the function of the nozzling device 10 is to accelerate fluid flow to the maximum attainable velocity. The valve element 11 of the nozzling device 10 opens fully with substantially no restriction to fluid flow and closes fully with no intermediate positions.

When the valve element 11 opens refrigerant accelerates from the higher pressure upstream inlet conduit 15 to the lower pressure downstream outlet conduit 20 at the inlet to an evaporator 22. The pressure drop across the nozzling device 10 drives fluid flow through its internal nozzle 16-18 which accelerates fluid flow to the maximum attainable velocity with substantially no flow restriction. The nozzling device 10 achieves substantially isentropic flow when open.

The pressure drop across the nozzling device 10 occurs due to the action of a compressor 23 when the valve element 11 is closed, raising the pressure in the discharge side of the system while lowering the pressure in the suction side of the system. High velocity fluid flow from the outlet 20 of the nozzling device 10 transfers momentum to oil at the inlet of, and within, the evaporator 22, moving oil through the evaporator 22 and pushing the oil through an evaporator outlet conduit 24 and back to the compressor 23.

The nozzling device 10 is actuated by a solenoid coil 26 which fully opens the valve element 11 when energized and fully closes the valve element 11 when deenergized. A setpoint self-regulating superheat switch 27 regulates the operation of the solenoid coil 26. An electrical conduit 28 transfers power between the electrical contacts of the superheat switch 27 and the solenoid coil 26. An electrical conduit 29 supplies power to the solenoid coil 26 through the contacts of the switch 27 and the conduit 28. Power from the conduit 29 fully opens the nozzling device 10 when the contacts of the switch 27 complete an electrical circuit between the conduits 29 and 28 and the coil 26. When the circuit between these elements is broken by the opening of the contacts of the switch 27, the solenoid coil 26 is deenergized and the nozzling device 10 returns to its normally closed condition.

A conduit 30 transfers pressure information from downstream of the nozzling device 10, sensing pressure within the conduit 20, upstream of the inlet of the evaporator 22, so as to transfer pressure information to the superheat switch 27. The conduit 30 is placed close to the outlet of the nozzling device 10 so that there is an immediate sensing of flow leaving the valve element 11. The conduit 30 can also sense pressure within the nozzle of the nozzling device 10. A conduit 32 transfers temperature information from a thermostatic bulb 33 to the superheat switch 27. In a typical bulb application, the temperature information is in the form of refrigerant pressure within the bulb 33. Temperature information from within the conduit 24 is transferred to the conduit 32 by the thermostatic bulb 33. The conjunction of the temperature information from the evaporator outlet conduit 24 and pressure information from the evaporator inlet conduit 20 continuously modulates the momentary pressure and temperature setpoint of the superheat switch 27.

As the compressor 23 lowers the pressure in the suction side of the system, and heat transferred from ambient to the evaporator heat exchanger 22 raises the temperature within the suction side of the system, the superheat switch 27 opens the nozzling device 10 when the pressure-temperature relation rises above the switch setpoint, permitting fluid to flow from within the upstream conduit 15 through the nozzling device 10 to the downstream conduit 20.

As the burst of fluid enters the conduit 20 it produces a pressure rise within the suction side of the system, changing the pressure-temperature relation between the sensed pressure and the sensed temperature. When the pressure-temperature relation is below the switch setpoint the contacts of the superheat switch 27 open and the solenoid coil 26 deenergizes closing the nozzling device 10 and stopping fluid flow through the nozzling device 10.

With the nozzling device 10 closed the compressor 23 lowers the suction side pressure as heat transfer from the ambient raises the suction side temperature until it is above the switch setpoint, resulting in the reopening of the nozzling device 10. As the nozzling device 10 alternates between fully open and fully closed conditions, fluid alternately flows and does not flow within the thermodynamic system.

The high velocity bursts of fluid flow into the evaporator heat exchanger 22 through the conduit 20 and out through conduit 24. When the evaporator 22 is fabricated as a substantially series, horizontal tube, heat exchanger with U-bends, the high velocity flow through the conduit 20 entering the evaporator 22 causes a momentum transfer to oil within the horizontal tubes. Thus oil return is accomplished to the compressor 23 due to the augmented pulsed high velocity flow events. The refrigerant velocities present in conventional evaporators with known expansion devices are substantially lower than the pulsed high velocities, to the order of magnitude that the refrigerant velocities in conventional systems are insufficient for moving immiscible oil.

Refrigerant from the conduit 24 flows to the compressor 23 which transfers mechanical energy to the fluid, increasing the pressure and temperature of the fluid and discharging it through a conduit 35 to an inlet of a condenser 36. When the nozzling device 10 opens to allow high impulse mass flow through the system, oil from the compressor discharge flows through conduit 35, through the condenser 36 and through the overall system. The high-velocity, high-impulse mass flow events transfer momentum to oil within the condenser 36, as well as within the tubing throughout the system.

Fluid flows out of condenser heat exchanger 36 to a filter-drier 37 which functions to remove contaminants and moisture from the refrigerant. Filtered refrigerant flows through the conduit 38 to a sight glass 39 and through the connecting conduit 15, returning to the nozzling device 10 to complete a thermodynamic cycle. The sight glass 39 indicates the quality of the refrigerant in the system, and is not required in all applications.

Since the thermodynamic system functions in the manner of a mechanical feedback loop, the self-regulating setpoint switch 27 will self-regulate the pressure and temperature setpoints at the evaporator inlet conduit 20 and the thermostatic bulb 33 to maintain the differential pressure between the conduit 32 and the conduit 30. The self-regulation is relational and hence, the magnitude of the sensed pressures can be from the vacuum range to the high pressure range, representing the entire range of pressures and temperatures the refrigerant and the thermodynamic system are able to maintain.

As noted previously this vapor-compression refrigeration process comprises a suction side from the nozzling device 10 through the evaporator 22 to the compressor 23 and a discharge side from the compressor 23 through the condenser 36 back to the nozzling device 10. The bursts of refrigerant flow are primarily positive impulsion pulses through the suction side of the process and primarily negative expulsion pulses through the discharge side of the process. The impulsion pulses increase fluid flow pressure and the expulsion pulses decrease fluid flow pressure, thereby accelerating mass flow of the refrigerant to high velocity sufficient to move the immiscible oil through all stages of the process.

As a consequence of a given burst of refrigerant flow temperature decreases in the conduit 24, and therefore pressure decreases in the bulb 32, while pressure increases in the conduit 30. When the difference in pressure between the conduits 32 and 30 reaches a pre-selected setpoint minimum, the contacts of the switch 27 open, the solenoid 26 is deenergized and the valve 11 is closed to stop refrigerant flow. This in turn causes the temperature to increase in the conduit 24, thus causing an increase in pressure in the bulb 32, while pressure decreases in the conduit 30. When the difference in pressure between the conduits 32 and 30 reaches a pre-selected setpoint maximum, the contacts of the switch 27 close, the solenoid 26 is energized and the valve 11 is opened to generate another burst.

The difference in pressure between 32 and 30 is the degree of superheat of the refrigerant fluid leaving the suction side of the process. The term "degree of superheat" means the difference between the actual temperature of the superheated vapor leaving the suction side of the process and the saturation temperature of the vapor for the existing pressure.

A typical system changeover substituting R-12 with R-134a refrigerant heretofore has involved replacing mineral oil used with R-12 with polyol ester oil used with R-134a. The present invention, however, enables a system changeover from R-12 to R-134a without changing the lubricating oil. As described above oil return to the compressor 23 is achieved by high velocity pulses which carry the mineral oil through the condenser 23 and the evaporator 22 back to the compressor 23.

The steps for a typical changeover in accordance with the invention will now be described.

First the R-12 refrigerant is removed from the system in accordance with applicable environmental and technical regulations. Some form of prior art expansion device will be present in the system and it must be initially removed, including typically capillary and orifice tubes, thermostatic expansion and evaporator pressure regulating valves and any distributor with internal restrictions.

The nozzling device 10 is then installed at the inlet of the evaporator 22, or upstream of an evaporator distributor system if one is present. The refrigeration system liquid line 15 is then attached to the inlet 12 of the valve 11 and the outlet 18 of the nozzle 16-18 of the nozzling device 10 is attached to the evaporator inlet conduit 20 or any evaporator-distributor inlet. A length of capillary tube from a pressure tap within the nozzle 16-18 or from a pressure tap within the evaporator inlet conduit 20 is attached to the nozzle pressure sensing port of the superheat switch 27 to enable the switch 27 to sense the nozzle and evaporator inlet pressure. The thermostatic bulb 33 of the superheat switch 27 is attached to the outlet 24 of the evaporator 22 where superheat determination is required or previously determined by the sensing bulb of the expansion valve. Alternatively the nozzling device 10 can be actuated by a pressure switch or by a temperature switch. Electrical power is then supplied to the superheat switch 27 to permit actuation of the solenoid valve 11 by the switch 27.

In accordance with standard practice a vacuum is then pulled in the system to remove water vapor and any remaining R-12 refrigerant from the oil within the system. The system is then charged with the new R-134a refrigerant in a manner consisted with the recommended charge amount for operation of the system, or in the case of a system with a liquid sight glass 39 the system is charged until the sight glass is full and the pressure in the evaporator 22 and condenser 36 are proper for the operating temperature. With the system running the amount of refrigerant charge is adjusted when necessary as equilibrium develops. The setting of the superheat switch 27 is adjusted when necessary by changing the differential pressure set point to optimize system performance as equilibrium develops. The system is then permitted to run, controlled by the thermostat, and other such controls preexisting on the equipment.

The system of the invention and its method of operation are defined in the following claims rather than in the foregoing description of a preferred embodiment.

We claim:

1. In a refrigeration process wherein a refrigerant circulates through successive stages of evaporation, compression, condensation and expansion, a method of simultaneously circulating therewith a lubricating oil immiscible in the refrigerant which comprises a) effecting said expansion by directing the refrigerant through a valve and nozzle in a nozzling device downstream of the condensation stage and upstream of the evaporation stage of the process, b) automatically fully opening and closing said valve in a binary fashion in response to sensing at least pressure of the refrigerant to create accelerated intermittent high velocity bursts of substantially unrestricted refrigerant flow from the nozzling device carrying through all stages of the process, and c) imparting to the immiscible oil by said bursts of refrigerant flow sufficient momentum to move the oil with the refrigerant through all stages of the process.

2. A method according to claim 1 wherein the refrigeration process comprises a suction side from expansion through evaporation to compression and a discharge side from compression through condensation back to expansion, and wherein said bursts of refrigerant flow are primarily positive impulsion pulses through said suction side of the process and primarily negative expulsion pulses through the discharge side of the process, impulsion pulses increasing fluid flow pressure and the expulsion pulses decreasing fluid flow pressure, thereby accelerating mass flow of the refrigerant sufficiently to move the immiscible oil through all stages of the process.

3. A method according to claim 2 wherein the opening and closing of said valve is in response to sensing changes in degree of superheat in the refrigerant flow leaving the suction side of the process.

4. A method according to claim 3 wherein said changes in the degree of superheat are sensed by monitoring changes in temperature between evaporation and compression in relation to changes in pressure between expansion and evaporation of the refrigerant flow.

5. A method according to claim 1 wherein the refrigerant is a substantially non-ozone-depleting fluid.

6. A method according to claim 1 wherein the refrigerant is R-134A and the immiscible oil is mineral oil.

7. In a vapor-compression refrigeration process wherein a substantially non-ozone-depleting refrigerant circulates through a suction side from expansion through evaporation to compression and then through a discharge side from compression through condensation back to expansion, a method of simultaneously circulating therewith a lubricating mineral oil immiscible in the refrigerant which comprises a) effecting said expansion substantially isentropically by directing the refrigerant through a valve and nozzle in a nozzling device downstream of the condensation stage and upstream of the evaporation stage of the refrigerant, b) automatically fully opening and closing said valve in a binary fashion in response to sensing changes in degree of superheat in the refrigerant flow leaving the suction side of the process to create accelerated intermittent high velocity bursts of substantially unrestricted refrigerant flow from the nozzling device carrying through all stages of the process, c) said changes in degree of superheat being sensed by monitoring changes in temperature between evaporation and compression and changes in pressure between expansion and evaporation of the refrigerant flow, d) said bursts of refrigerant flow being primarily positive pressure-increasing impulsion pulses through said suction side of the process and primarily negative pressure-decreasing expulsion pulses through the discharge side of the process, and e) imparting to the immiscible oil by said bursts of refrigerant flow sufficient momentum to move the oil within the refrigerant through all stages of the process.

* * * * *